United States Patent [19]

Peterson et al.

[11] 4,322,945

[45] Apr. 6, 1982

[54] FUEL NOZZLE GUIDE HEAT SHIELD FOR A GAS TURBINE ENGINE

[75] Inventors: Steven C. Peterson; Leonard W. Stevens, both of Vernon; Ibrahim S. Tanrikut, Manchester, all of Conn.

[73] Assignee: United Technologies Corporation, Hartford, Conn.

[21] Appl. No.: 136,633

[22] Filed: Apr. 2, 1980

[51] Int. Cl.[3] ..... F02C 7/22

[52] U.S. Cl. ..... 60/39.32; 60/740; 60/756

[58] Field of Search ..... 60/756, 740, 748, 752, 60/39.32

[56] References Cited

U.S. PATENT DOCUMENTS

| | | | |
|---|---|---|---|
| 3,273,343 | 9/1966 | Cretella | 60/748 |
| 3,385,055 | 5/1968 | Koblish et al. | 60/748 |
| 3,866,413 | 2/1975 | Sturgess | 60/748 |
| 3,901,446 | 8/1975 | Petreikis | 60/756 |
| 4,180,974 | 1/1980 | Stenger et al. | 60/756 |

FOREIGN PATENT DOCUMENTS

| | | | |
|---|---|---|---|
| 2232286 | 1/1973 | Fed. Rep. of Germany | 60/756 |

*Primary Examiner*—Robert E. Garrett

*Attorney, Agent, or Firm*—Norman Friedland

[57] ABSTRACT

This invention relates to the construction of the heat-shield of a fuel nozzle guide of a tubine power plant and provides the separation of the higher temperature operating structure from the cooler structure to assure that the expansion and contraction is permitted without undue restrain for increasing its durability.

4 Claims, 5 Drawing Figures

FUEL NOZZLE GUIDE HEAT SHIELD FOR A GAS TURBINE ENGINE

CROSS REFERENCE

This invention is related to the invention disclosed in copending patent application entitled FUEL NOZZLE GUIDE AND SEAL FOR A GAS TURBINE ENGINE, filed by J. A. Matthews, D. A. Washburn and V. J. Sarli on even date and assigned to the same assignee of this application.

TECHNICAL FIELD

This invention relates to gas turbine engines and particularly to the heat shield of the fuel nozzle attached at the front end of an annular combustor.

BACKGROUND ART

As is well known in the gas turbine engine art, the durability of engine components is of paramount importance and, obviously the longer an engine component endures, the longer an engine can perform without the costly shutdown of the airplane necessitated by the repair or replacement of such components. It is therefore a constant concern to develop components that can withstand the hostile environment to which they are subjected. As to be expected, one area that has been particularly troublesome is in the combustor and particularly where the fuel nozzles interface with the combustor liner. The fuel nozzle guide that seals the fuel nozzle at the front end of the annular combustor has been subjected to extraordinary thermal stresses and has heretofore been a maintenance problem.

Heretofore, the heat shield was made integral with the liner wall. The heat shield not only served to protect the nozzle structure, it also served to support the nozzle guide that ultimately carried the fuel nozzle. Owing to the fact that upstream of the heat shield adjacent the fuel nozzle shows a lower temperature than the heat shield structure, the high thermal stresses tended to reduce the useable life of the heat shield. Because of the heretofore conventional design, the repair and/or replacement was a complex maintenance problem as it required cutting out the heat shield structure from the liner and rewelding a repaired or replacement one.

We have found that we can obviate the problems noted above by separating the higher temperature operating structure from the cooler operating structure permitting uninhibited thermal expansion. Also, in accordance with this invention, removal of the heat shield is simplified and the cost of maintenance thereof is reduced by permitting removal of the heat shield without compromising the supporting combustor liner.

DISCLOSURE OF THE INVENTION

An object of this invention is to provide an improved heat shield for the fuel nozzle mounted on the front end of an annular combustor of a turbine type power plant. A feature of this invention is to separate the heat shield from the normally cooler louver liner bulkhead to permit unimpaired thermal expansion and contraction.

Another feature of this invention is to judiciously locate the cooling air holes for cooling improvement and the air purge holes for flameholding prevention.

Other features and advantages will be apparent from the specification and claims and from the accompanying drawings which illustrate an embodiment of the invention.

BEST MODE FOR CARRYING OUT THE INVENTION

Figure 1:
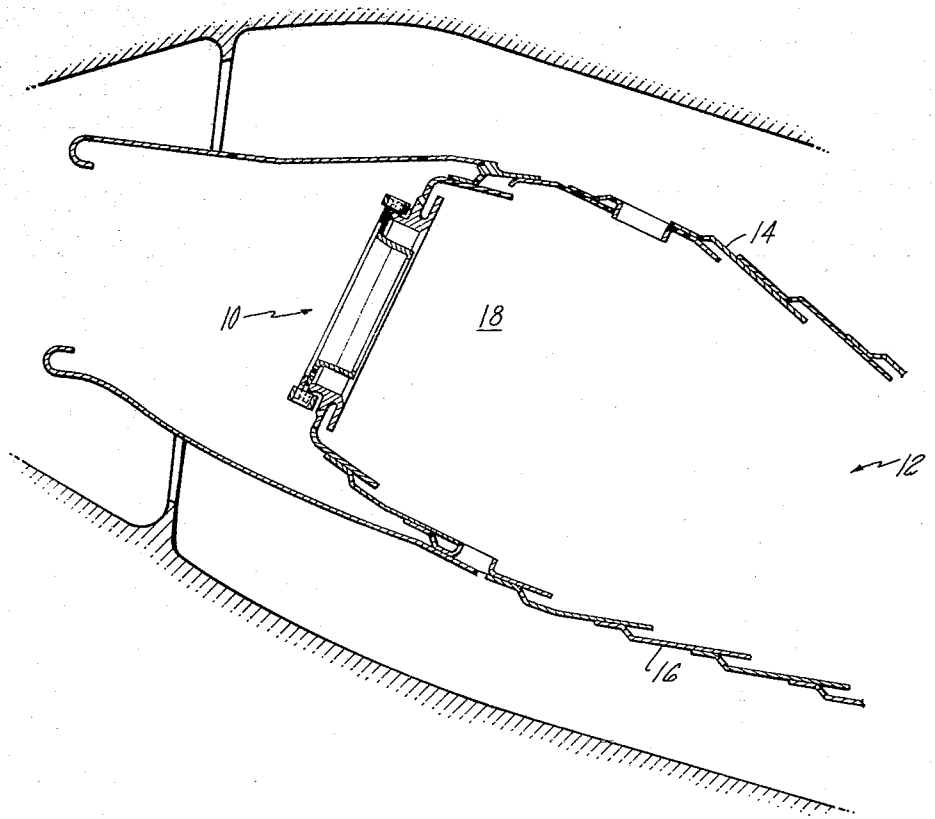
FIG.1 PRIOR ART
FIG. 1 is a partial view partly in schematic and partly in section showing the prior art heat shield conventionally formed integrally with the combustion chamber.

As was noted above, the invention is for securing and protecting the fuel nozzle to the front end of an annular combustor of the type, for example, utilized on the JT-9D engine manufactured by the Pratt and Whitney Aircraft Group of United Technologies Corporation, the assignee of this patent application and to which reference is incorporated herein. The prior art construction is shown in FIG. 1 and as noted only one of several nozzle guides 10 are shown. However, it will be appreciated that a plurality of such devices are mounted circumferentially about the front end of the annular combustor generally illustrated by reference numeral 12. The combustor formed from the conventional louver liner comprises an outer annular liner member 16 an an inner annular liner member 14 joined together to form a toroidally shaped combustion chamber 18. The nozzle guide serves to support the fuel nozzle (not shown) in the front end of the combustor and the guide serves to allow the nozzle to move relative to the liner. Hence, the guide which carries the fuel nozzle is restrained axially but moves radially as will be fully explained hereinbelow. In this guide configuration, the guide carries on its rearward end facing the combustion chamber 18 a radially extending flange which serves as a heat shield for thermally protecting the fuel nozzle and its supporting structure.

Figure 4:
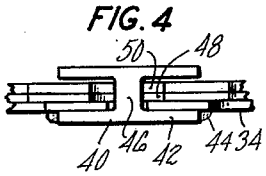
FIG. 4 is a partial top view of FIG. 2.
Figure 3:
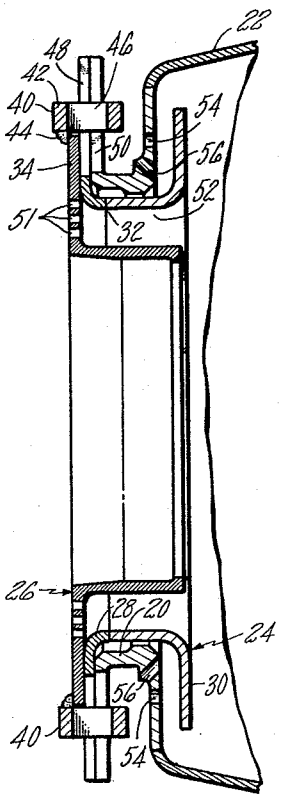
FIG. 3 is a sectional view taken along lines 3—3 of FIG. 2.
Figure 2:
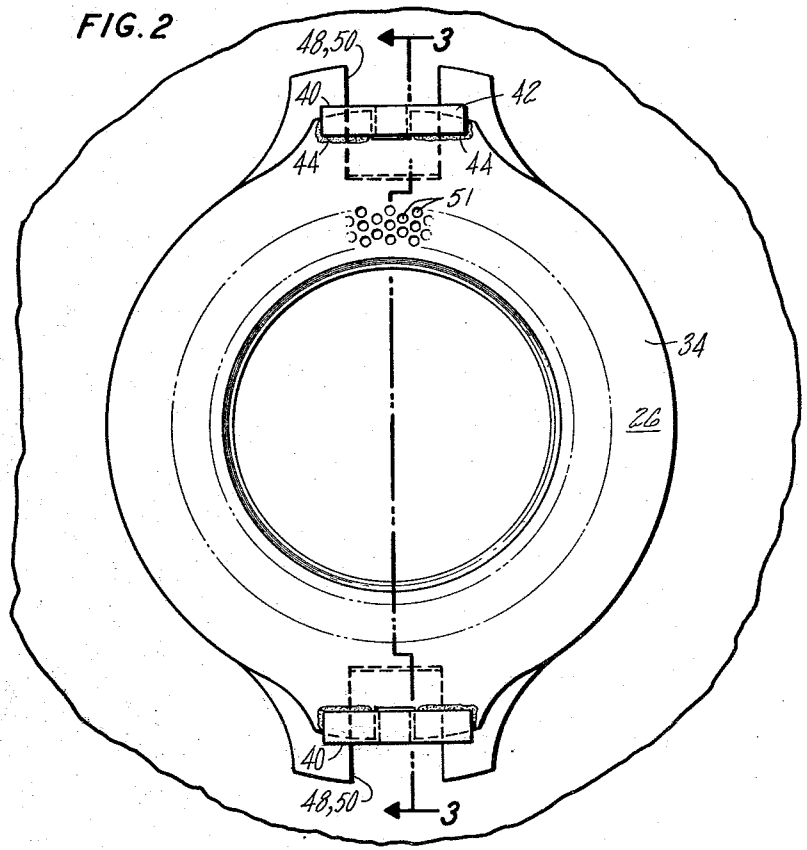
FIG. 2 is a view in elevation showing the details of this invention.

The invention can best be understood by referring to FIGS. 2–4 which shows one of the fuel nozzle guides, heat shield and support structure. It will be appreciated that the combustor liner carries a front end annular element joining the inner and outer liner which carries a plurality of circumferentially spaced openings for receiving each of the nozzle guides and its attendent structure. For further details of this construction reference should be made to the JT-9D engine, supra. As will be noted in FIG. 3, machined bulkhead 20 is welded to the combustor front wall 22 and serves to loosely support the heat shield generally referenced by numeral 24 and fuel nozzle guide 26. Heat shield 24 comprises a pair of rings 28 and 30 which are butt welded in situ along weldment 32 after trapping the machined bulkhead 20. The flange portion 34 of the fuel nozzle guide 26 bears against the face of ring 28. The H-shaped element 40 serves to secure the fuel nozzle guide 26 in sliding relationship to heat shield 28 and liner bulkhead 20. The front leg 42 of the H-shaped clip is welded to the face of fuel nozzle guide 34 along weldment 44 trapping the ring 28 and the upstanding flange of machined bulkhead 20. The interconnecting transverse portion 46 of the H-shaped clip rides radially in the complimentary grooves 48 and 50 formed in ring 28 and the upstanding flange of the machined bulkhead 20.

From the foregoing, it is apparent that the fuel nozzle guide 26 bonded to the H-shaped clip 40 is restrained axially by the parallel spaced walls of the H-shaped clip and is allowed to move radially in the confines of grooves 48 and 50. Additionally, the H-shaped clip 40 serves to restrain rotational movement of heat shield 24.

It is also apparent that the heat shield 24 is a unitary element that is only secured by being trapped between the liner bulkhead flanges and fuel nozzle guide and being restrained therein by the H-shaped clip. In engine operation, when the combustor is fired, the ring 30 of the heat shield is exposed to the highest temperature while the liner bulkhead is exposed to a much lower temperature. Hence, the high temperature differential which heretofore incurred high thermal stresses on the heretofore machined bulkhead and heat shield combination limited the life thereof. Owing to the separation of the heatshield with the flexibility of being able to contract and expand independently of the other attendent structure, the life of the heat shield is greatly extended.

Another important aspect of this invention is that the problem attendent localized heat spots owing to flameholding occasioned by stagnation zones in the combustor is minimized. As is well understood, combustion is sustained in recirculation zones in the combustor which zones are relatively quiescent relative to the velocity of the gaseous streams. Hence, stagnation zones that exist in proximity to where the fuel is injected will hold the flame. Obviously, an unwanted flameholding zone is undesirable inasmuch as it heats the material in proximity thereto. To prevent this from occurring and in accordance with this invention, a plurality of apertures 50 are formed in the face of flange 34 of the fuel nozzle guide 26. Compressor air upstream of the combustor flows through apertures 50 purging the annular gap 52 formed between fuel nozzle guide 26 and heat shield 24.

Cooling of the heat shield and machined bulkhead 20 is provided by passing compressor discharged air through openings 54 and 56 formed in the machined bulkhead which openings are selected for impingement cooling on the backside of the heat shield fire facing element and directed in such a manner to film cool the machined bulkhead.

Figure 5:
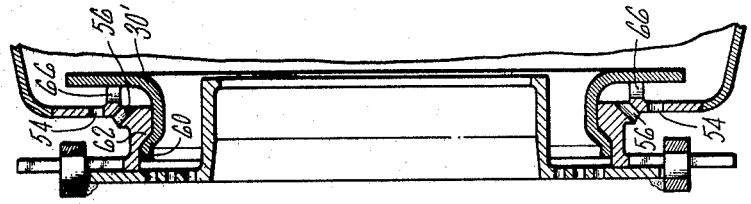
FIG. 5 is a sectional view showing another embodiment of this invention.

FIG. 5 exemplifies another embodiment of this invention and for most respects it is identical to the structure shown in FIG. 2–4. The significant difference is that ring 28 and the attendent butt weldment 32 are eliminated and are replaced by crimping ring 30' in situ at the end 60 to bear against shoulder 62 formed on the inner diameter of bulkhead 20.

This modified version permits the use of circumferentially spaced tabs 66 which serve to axially position ring 30 and to prevent the ring 30' which is subjected to the high temperature occasioned by combustion from collapsing and impeding the flow of cooling air egressing from openings 54 and 56.

In both configurations, it will be appreciated that the replacement of the heat shield is facilitated, since the removal thereof is greatly simplified. As was noted above, the heretofore used conventional heat shield shown in the prior art of FIG. 1 is made integral with the combustion chamber and removal thereof required cutting of the combustion chamber structure. In the configuration of FIG. 2–4, the heat shield is removed by merely removal of the weldment 32 to separate the rings 28 and 30 after the fuel nozzle guide is removed. Hence, new rings would be welded in situ and the nozzle guide replaced without incurring structural changes to the liner of the combustor.

In the configuration of FIG. 5, the uncrimping of ring 30' would be sufficient to remove the heat shield and a new ring would be crimped as was described hereinabove.

It should be understood that the invention is not limited to the particular embodiments shown and described herein, but that various changes and modifications may be made without departing from the spirit and scope of this novel concept as defined by the following claims.

We claim:

1. An annular combustor for a turbine type power plant having a toroidally shaped forward end portion relative to the flow of combustion products flowing therein, a plurality of fuel guide and heat shield members mounted in circumferentially spaced holes formed in said forward end portion for supporting, sealing and protecting fuel nozzles intended to supply fuel to the annular combustor, said fuel guide and heat shield members comprising a sleeve element having a forward flange extending beyond the opening, a flange element being U-shaped in cross section having an upstanding portion spaced from and parallel with said forward flange of said sleeve element, a first ring element and a second ring element being joined in situ and having a U-shaped cross section with one leg of said first ring parallel to and abutting the face of said forward flange and the other leg of said second ring having a forward face for shielding the fuel guide and heat shield member from the flame in the combustor, a bulkhead having an extended flange parallel to and abutting said leg of said first ring, means for securing said sleeve, said first and second ring and said bulkhead so that said sleeve is in sliding relation to said bulkhead.

2. An annular combustor as in claim 1 including clip means having an H-shaped body, one leg of said H being joined to the face of said flange of said sleeve and the other bearing against the remote face of said bulkhead and the transverse portion of said H disposed in complimentary slots formed in said first ring and said bulkhead.

3. An annular combustor as in claim 2 including means for preventing flame holding adjacent said sleeve including holes in said flange of said sleeve in axial alignment with the space defined between said sleeve and the bottom portion of said U-shape of said first and second rings.

4. An annular combustor as in claim 3 including means for cooling said heat shield by directing cooling air from openings formed on said bulkhead onto the back face of said second ring and defining a gap between said second ring and said bulkhead to form a film of cooling air.

* * * * *